US006382640B1

(12) United States Patent
Killian

(10) Patent No.: US 6,382,640 B1
(45) Date of Patent: May 7, 2002

(54) LATITUDINAL ALIGNED MONO-WHEEL SKATE DEVICE

(76) Inventor: Michael Killian, 32 Westland Ave., Apt. 16, Boston, MA (US) 02115

( * ) Notice: Subject to any disclaimer, the term of this patent is extended or adjusted under 35 U.S.C. 154(b) by 0 days.

(21) Appl. No.: 09/981,936

(22) Filed: Oct. 17, 2001

(51) Int. Cl.[7] ..... A63C 17/08
(52) U.S. Cl. ..... 280/11.24; 280/809
(58) Field of Search ..... 280/11.24, 11.19, 280/11.27, 11.28, 11.3, 809, 11.25

(56) References Cited

U.S. PATENT DOCUMENTS

| | | | | | |
|---|---|---|---|---|---|
| 92,936 | A | | 7/1869 | Brownlee | 280/11.24 |
| 363,716 | A | * | 5/1887 | Yost | 280/11.24 |
| 889,580 | A | * | 6/1908 | Carlsson | 280/11.24 |
| 1,023,882 | A | | 4/1912 | Schiesari | 280/11.24 |
| 2,198,857 | A | * | 4/1940 | Branson | 280/11.24 |
| 2,520,793 | A | | 8/1950 | Blackwell | 280/11.24 |
| 2,675,243 | A | | 4/1954 | King | 280/11.24 |
| 2,931,012 | A | | 3/1960 | Kosach | |
| 2,996,306 | A | * | 8/1961 | Johnson | 280/11.24 |
| 3,663,031 | A | | 5/1972 | Young | 280/11.24 |
| 4,108,451 | A | * | 8/1978 | Scheck, Sr. | 280/11.24 |
| 4,310,168 | A | | 1/1982 | Macazuso | 280/11.24 |
| 4,363,493 | A | | 12/1982 | Veweklasen | 280/11.2 |
| 4,709,937 | A | | 12/1987 | Lin et al. | 280/11.2 |
| 4,943,073 | A | | 7/1990 | Wander | 280/47.27 |
| 4,943,075 | A | | 7/1990 | Gates | 280/842 |
| 4,991,861 | A | | 2/1991 | Carn et al. | 282/87.042 |
| 5,092,614 | A | | 3/1992 | Malewicz | 280/11.22 |
| 5,106,110 | A | | 4/1992 | Williamson | 280/11.2 |
| 5,160,155 | A | | 11/1992 | Barachet | 280/87.042 |
| 5,193,827 | A | | 3/1993 | Olson | 280/7.13 |
| D347,044 | S | * | 5/1994 | Slack et al. | 280/11.24 |
| 5,312,120 | A | | 5/1994 | Wiegner | 280/11.2 |
| 5,390,958 | A | | 2/1995 | Soo | 280/844 |
| 5,411,277 | A | | 5/1995 | Pratt | 280/11.22 |
| 5,437,466 | A | | 8/1995 | Melbock et al. | 280/11.22 |
| 5,779,247 | A | | 7/1998 | Anselmo | 280/11.22 |

* cited by examiner

*Primary Examiner*—Michael Mar

(57) ABSTRACT

A mono-wheel skate device with wheel mounted in a latitudinal direction.

The axis of rotation of the wheel is aligned with the axis that runs between the boot toe and the boot heel. The direction of the wheel is perpendicular to the axis that runs between the boot toe and the boot heel and the wheel rim spins on guide wheel members connected to a guide wheel support member which connect to a protective boot. The user balances the device by continuously correcting the orientation of each boot. For example when the user feels himself/herself falling forward out of balance, the user moves his/her feet in such a way as to bring his/her toes closer together which tracks the boots forward of the original line of motion and thus regaining balance. The user must be in a state of constant correction which with practice will become natural and reflex. This device moves the user in a sideways direction and it is up to the user to decide to move to the user's right or to the user's left. The user must avoid tripping the leading boot wheel on any rough terrain. Tripping is avoided by shifting his/her weight to the rear boot and stepping over the rough terrain.

Propelling the device forward requires actions different from regular in-line skates. The user moves his feet so that his/her feet remain parallel to each other but his/her toes are to the right or the left of his/her heels. Assuming the user wishes to propel himself/herself to the right then his/her toes should be to the right of his/her heels while both feet are still parallel. While holding his/her feet in this orientation with respect to each other the user simply walks forward. The rearward pull of each boot in this walking motion causes the wheel attached to that boot to roll in the direction of the right. Thus the user moves to the right. When sufficient speed is attained and the user wishes to coast the user moves his/her feet square with respect to the direction of travel. Once the user has mastered the basics of propulsion and turning the user can start introducing his/her weight into the turns by leaning into the turns. The feedback from this device is strongest when the user uses his/her weight. This device may not compete with regular in-line skates with respect to distance traveled or speed of operation; however this device will excel in carving endless turns. Much like the difference between a snowboard and regular ski's.

4 Claims, 4 Drawing Sheets

LATITUDINAL ALIGNED MONO-WHEEL SKATE DEVICE

FIELD OF THE INVENTION

The present invention relates to recreational devices like in-line skates and bicycles.

BACKGROUND OF THE INVENTION

The invention relates to in-line roller skates and bicycles and comprises a single wheel mounted in a latitudinal direction on each boot. More specifically, the present invention relates to recreational devices which can be used to traverse smooth and rough terrain including mountain slopes.

There are many types of mono-wheel devices in the prior art. A mono-wheel wheel device was first described in 1869 in U.S. Pat. No. 92,936 of Brownlee. Another mono-wheel device was described in 1912 in U.S. Pat. No. 1,023,882 of Schiesari. Another mono-wheel device was described in 1950 in U.S. Pat. No. 2,520,793 of Blackwell. Another mono-wheel device was described in 1954 in U.S. Pat. No. 2,675,243 of King. Another mono-wheel device was described in 1960 in U.S. Pat. No. 2,931,012 of Kosach. Another mono-wheel device was described in 1972 in U.S. Pat. No. 3,663,031 of Young. Another mono-wheel device was described in 1980 in U.S. Pat. No. 4,310,168 of Macaluso. Another mono-wheel device was described in 1980 in U.S. Pat. No. 4,363,493 of Veneklasen. Another mono-wheel device was described in 1998 in U.S. Pat. No. 5,779,247 of Anselmo. All prior art of mono-wheel skate devices have the wheel mounted in a longitudinal direction with respect to the user's foot.

Human balance can be considered in two separate axes. Human balance left side to right side and human balance front to back. Left to right human balance is relatively inaccurate; as evidenced by trying to stand on one foot. However since the human body has two feet there is a constant correcting mechanism by moving ones hips and upper body relative to both left and right foot. This endless correction makes left to right balance very useful for walking and standing. Devices based on human left to right balance, like the bicycle tap into this constant correcting mechanism. A bicycle is in a constant state of losing its balance and with the endless correcting of the front wheel it is kept in balance. People learn to ride a bicycle because this constant correcting is much like the person's natural left to right correction.

Front to back balance is in many ways much more accurate as evidenced by the operation of the ankle and foot as you lean slightly forward. There is none of the left to right instability as when you stand on one foot. The big difference in front to back balance is that it has leverage much closer to the ground for correcting balance; namely the ankle and foot. This means that the balance correction is quicker for front to back balance. One simply has to apply pressure on his/her soles or heels. Rarely is upper body weight shifting involved in front to back balance correction.

Devices that leverage front to back balance include snowbirds and to a lesser extent skateboards. In both cases balance is restored by pushing down on ones toes with respect to ones heels or lifting ones toes. This action in a snowboard causes the board to carve into the snow in a forward or rearward direction and thus recovering balance. These actions in a skateboard causes the truck to change the relative orientation of the rear axle with respect to the front axle and turning toward the front or towards the rear and again regaining balance. Snowboards and skateboards traveling at high speed tend to be difficult to control and are better suited to slow speed artistic expression. This is because the length of a person's foot is relatively short when compared with the distance between left and right foot with feet apart.

Devices that leverage left to right balance include regular ski's and currently available in-line skates. Mono-wheel skates with wheels mounted in a longitudinal direction primarily leverage human left to right balance. Front to back balance is needed to stop the user falling forward or backward but is not leveraged to a great extent. It should be noted that all prior art mono-wheel skates with wheels mounted in a longitudinal direction are fundamentally unstable. The front to back correcting mechanism of the user's feet and ankles have no corresponding mechanism with these devices. The unicycle on the other hand, operates with a fixed gear and the user can affect front to back correction by pedaling forward or backward. Ski's and in-line skates are more controllable at high speed because the distance between right and left feet is greater than the length of a person's foot.

The present invention discloses a mono-wheel skate device with wheels mounted in a latitudinal direction. This will leverage human front to back balance primarily with left to right balance having secondary input; generally dealing with not tripping. The user balances the device by continuously correcting the orientation of each boot. For example when the user feels himself/herself falling forward out of balance, the user moves his/her feet in such a way as to bring his/her toes closer together which tracks the boots forward of the original line of motion and thus regaining balance. The user must be in a state of constant correction which with practice will become natural and reflex. This device moves the user in a sideways direction and it is up to the user to decide to move to the user's right or to the user's left. The user must avoid tripping the leading boot wheel on any rough terrain. Propelling the device requires actions different from regular in-line skates. The user moves his feet so that his/her feet remain parallel to each other but his/her toes are to the right or the left of his/her heels. Assuming the user wishes to propel himself/herself to the right then his/her toes should be to the right of his/her heels while both feet are still parallel. While holding his/her feet in this orientation with respect to each other the user simply walks forward. The rearward pull of each boot in this walking motion causes the wheels under that boot to roll in the direction of the right. Thus the user moves to the right. When sufficient speed is attained and the user wishes to coast the user moves his/her feet square with respect to the direction of travel. Once the user has mastered the basics of propulsion and turning the user can start introducing his/her weight into the turns by leaning into the turns. The feedback from this device is strongest when the user uses his/her weight. This device may not compete with regular in-line skates with respect to distance traveled or speed of operation. However it is expected that this invention will excel at carving turns and will work best on inclines of asphalt or grass. It is expected that this invention will be more expressive than regular in-line skates and will reward the operator with much positive feedback of having mastered his/her balance. An optional elastic member attached between each boot allows the user's feet to remain at an optimal angle without straining the user's leg muscles. The device can be motorized by attaching a simple bicycle motor to one boot and this motor can drive against the inside of the wheel rim.

SUMMARY OF THE INVENTION

It is an object of the present invention to provide a mono-wheel skate device.

It is a more particular object of the invention to provide a mono-wheel skate with wheels mounted in a latitudinal direction, whose axis of rotation is parallel to the axis of the skate boot that runs between the boot toe and the boot heel.

It is an object of the present invention to provide a mono-wheel skate with wheels mounted in a direction that is perpendicular to the axis that runs between the boot toe and the boot heel.

It is another object of the present invention to provide an integral boot that supports the user's foot and restricts the motion of the user's ankle.

It is another object of the present invention to provide a guide wheel support member attached to the boot and mounted in a latitudinal direction.

It is another object of the present invention to provide a number of guide wheels supported by the guide wheel support member that engage the rim of the wheel. These guide wheels have a concave surface that forces the wheel to run in a latitudinal direction and stops the wheel from disengaging from the device.

It is another object of the present invention to provide an optional elastic member connecting each boot together that holds the user's feet in an optimal angle and prevents the user's feet from doing the splits.

DESCRIPTION OF THE DRAWINGS

These and other aspects of the present invention will become more evident upon reading the following description of the preferred embodiment in conjunction with the accompanying drawings, in which.

DETAILED DESCRIPTION OF PREFERRED EMBODIMENTS

Figure 1:
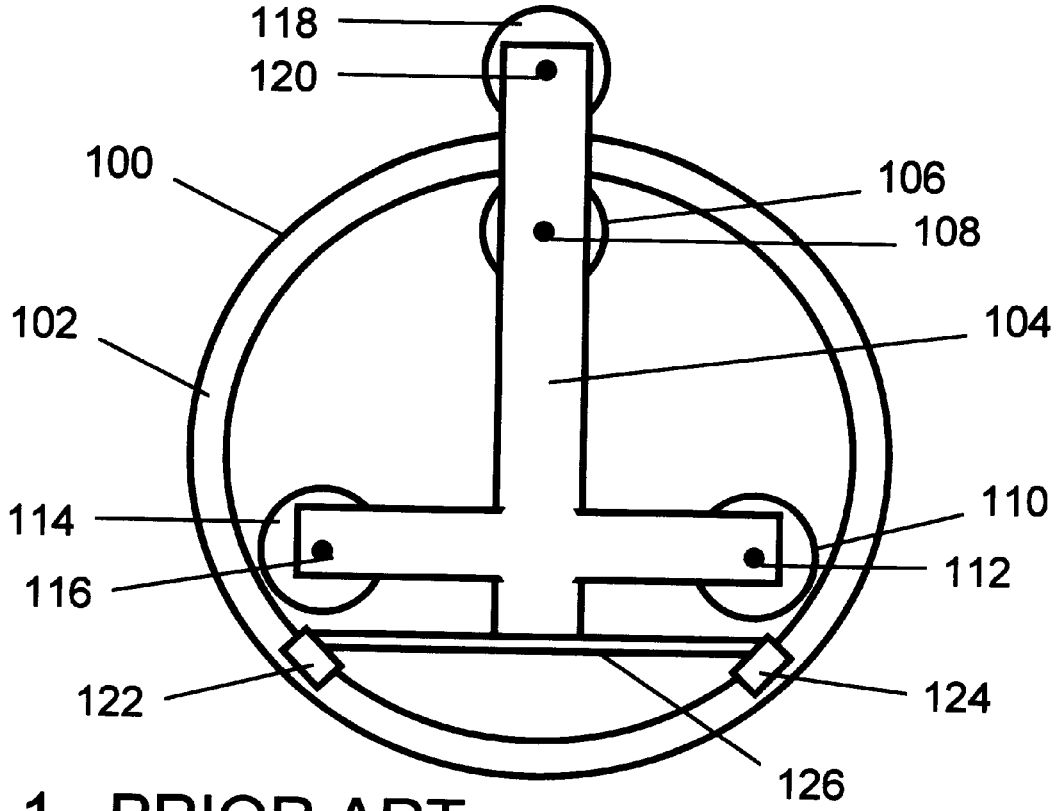
Fig. 1 PRIOR ART
FIG. 1 is a prior art side view of a mono-wheel device.
Figure 2:
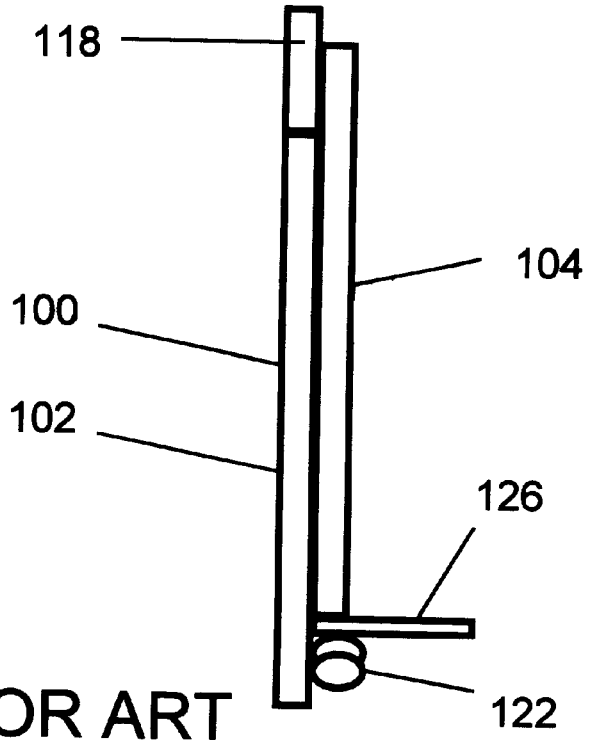
Fig. 2 PRIOR ART
FIG. 2 shows the mono-wheel device of FIG. 1 as seen from the rear.

FIG. 1 and FIG. 2 illustrates a prior art mono-wheel device 100. In FIG. 1 and FIG. 2 the wheel member 102 rotates about the bearing support member 104 by means of the guide wheels 106, 110, 114, 118, 122 and 124. The user's foot is placed on the foot plate member 126 so that the user's foot is parallel to the plane of the wheel 102. The wheel 102 rotates in a direction parallel to a line running between the heel and toe of the user's foot. Each guide wheel runs about an ail. Wheel 106 runs about ail 108. Wheel 110 runs about ail 112. Wheel 114 runs about ail 116. Wheel 118 runs about ail 120.

Figure 3:
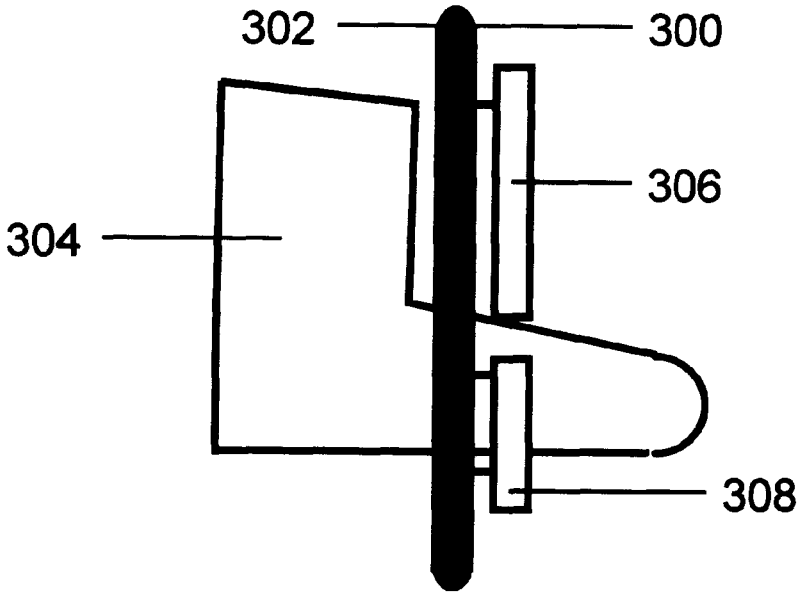
FIG. 3 is a side view of the present invention.
Figure 4:
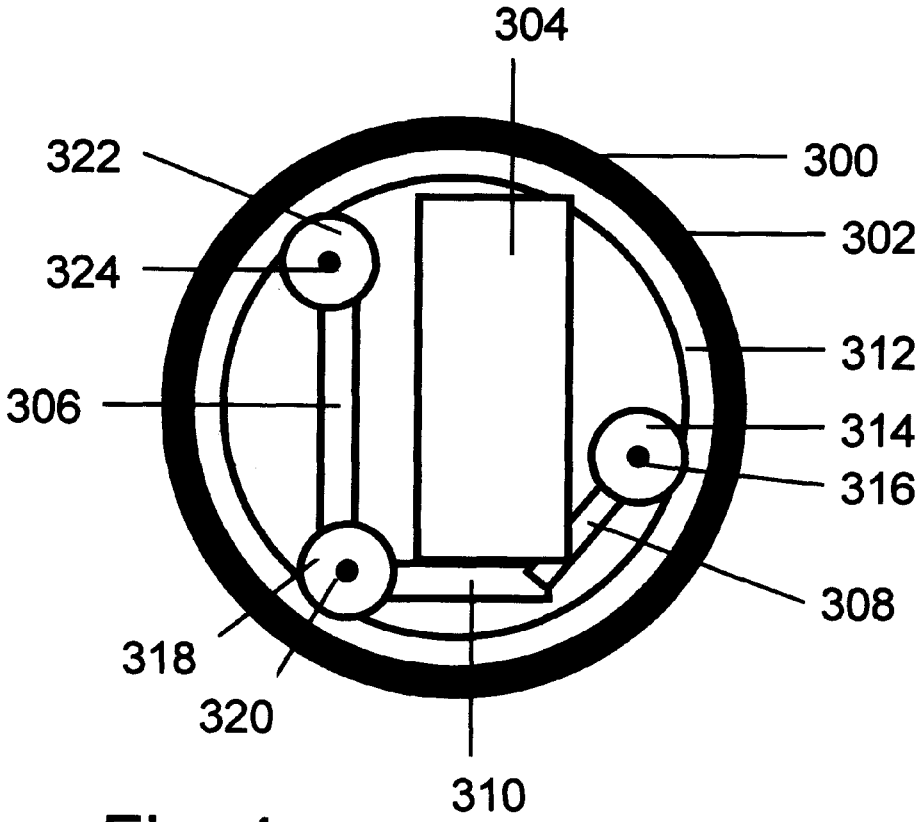
FIG. 4 shows the present invention of FIG. 3 as seen from the rear.

FIG. 3 and FIG. 4 illustrates the current invention 300. In FIG. 3 and FIG. 4 the mono-wheel member 302 is mounted on rim member 312 and rotates about the guide wheel support member 306, 308 and 310 by means of the guide wheel wheels 314, 318 and 322. Guide wheel 314 rotates around axle 316 and has a concave profile which engages the convex profile of the rim member 312. Guide wheel 318 rotates around axle 320 and has a concave profile which engages the convex profile of the rim member 312. Guide wheel 322 rotates around ail 324 and has a concave profile which engages the convex profile of the rim member 312. The protective boot 304 is attached to the guide wheel support member 310. The user's foot is placed in the protective boot 304 and the plane of the mono-wheel member 302 is perpendicular to the user's foot. The plane of the mono-wheel member 302 is perpendicular to a line running between the heel and toe of the user's foot. The mono-wheel member 302 and rim member 312 rotate around an imaginary axle which is parallel to the user's foot. The mono-wheel member 302 and rim member 312 rotate around an imaginary ail which is parallel to a line running between the heel and toe of the user's foot.

Figure 5:
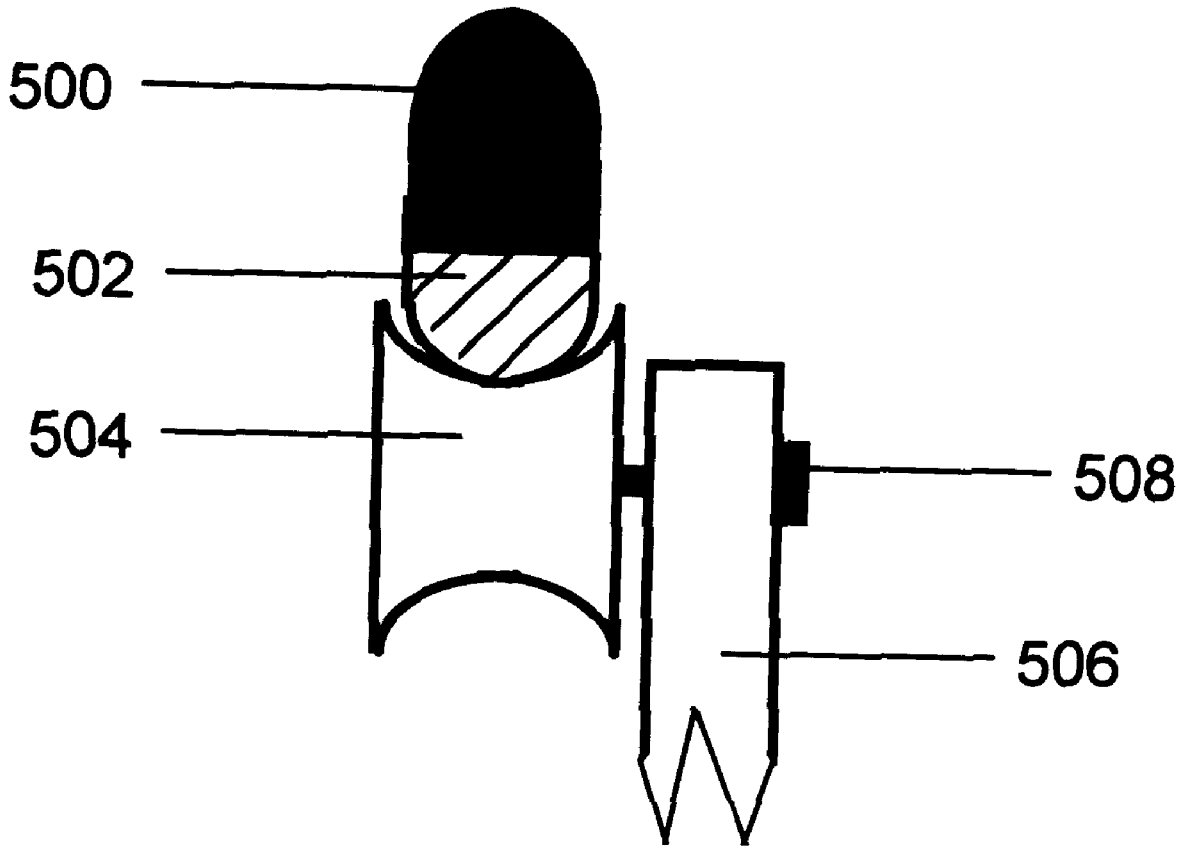
FIG. 5 shows the cross sectional profile of the wheel rim and guide wheel surface of the present invention.

FIG. 5 illustrates a cross sectional view of a portion of the current invention. In FIG. 5 the mono-wheel member 500 is mounted on rim member 502. Guide wheel 504 rotates about axle 508 attached to guide wheel support member 506. Guide wheel 504 has a concave profile that runs against the convex surface of rim member 502. Mono-wheel member 500 and rim member 502 are restricted to running in one plane only by the holding of the concave guide wheel profile of all three guide wheel's against the convex rim profile. In the preferred embodiment the mono-wheel is constructed of closed cell foam material which does not have a filler valve.

Figure 6:
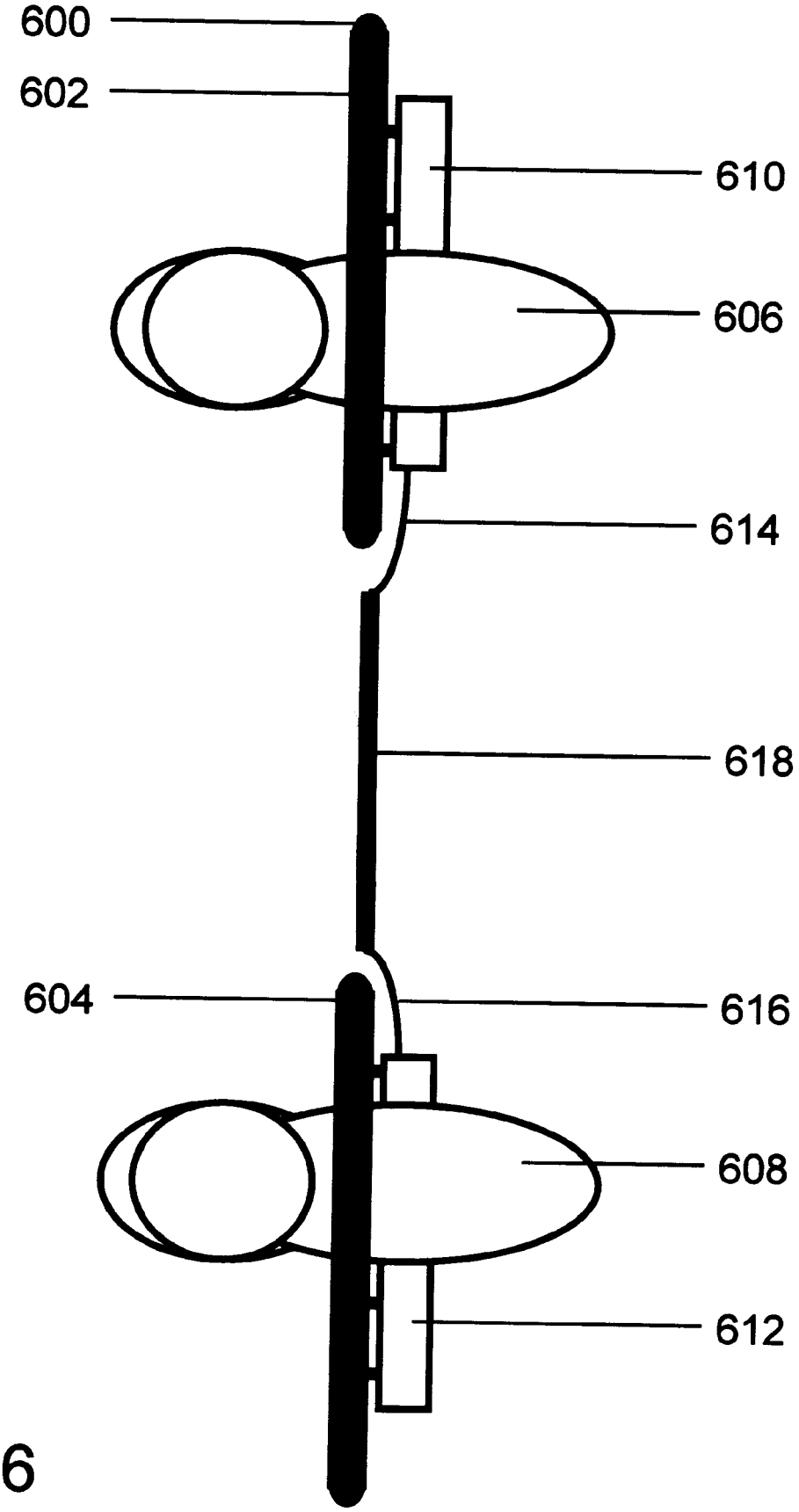
FIG. 6 is a top view of the present invention showing both left and right elements.

FIG. 6 illustrates a top view of the current invention 600 showing both left and right mono-wheel elements. In FIG. 6 the left mono-wheel member 602 is mounted in a latitudinal direction with respect to a line running between the heel and toe of protective boot 606. The right mono-wheel member 604 is mounted in a latitudinal direction with respect to a line running between the heel and toe of protective boot 608. The left guide wheel support member is represented by 610 and the right guide wheel support member is represented by 612. An elastic member 618 is attached to the left mono-wheel element by bracket 614 and to the right mono-wheel element by bracket 616. The elastic member 618 keeps the user's feet at the optimal distance apart without straining the user's inner leg muscles.

What is claimed is:

1. A mono-wheel skate assembly comprising:

a single wheel having an outer circumferential surface configured for rolling contact with a ground surface and an inner circumferential surface formed by an inner rim, the single wheel having a plane aligned with a rolling direction of the skate device;

a support frame having a plurality of guide wheels attached thereto, the support frame being mounted within a central opening formed by the inner rim of the single wheel, the support frame and the guide wheels being configured for maintaining the plurality of guide wheels in continuous rolling contact with the inner rim thereby permitting the single wheel to roll along a ground surface while the support frame maintains a substantially fixed orientation with respect to the ground surface; and a single boot configured for receiving and supporting a single foot of a user, the boot having an elongated foot supporting portion with a longitudinal axis extending between heel and toe portions of the boot, the boot being fixedly attached to the support frame with part of the foot supporting portion extending through a central opening of the wheel formed by the inner rim and with the longitudinal axis of the foot supporting portion of the boot extending perpendicular to the plane formed by the single wheel.

2. A mono-wheel skate assembly according to claim 1, wherein said inner rim has a convex profile and each of said guide wheels has a circumferential outer surface with a concave profile which is in rolling engagement with said inner rim.

3. A skate assembly comprising:

a pair of mono-wheel assemblies, each mono-wheel assembly including a single wheel having an outer circumferential surface configured for rolling contact with a ground surface and an inner circumferential surface formed by an inner rim, the single wheel having a plane aligned with a rolling direction of the skate device; a support frame having a plurality of guide wheels attached thereto, the support frame being mounted within a central opening formed by the inner rim of the single wheel, the support frame and the guide wheels being configured for maintaining the plurality of guide wheels in continuous rolling contact with the inner rim thereby permitting the single wheel to roll along a ground surface while the support frame maintains a substantially fixed orientation with respect to the ground surface; and a single boot configured for receiving and supporting a single foot of a user, the boot having an elongated foot supporting portion with a longitudinal axis extending between heel and toe portions of the boot, the boot being fixedly attached to the support frame with part of the foot supporting portion extending through a central opening of the wheel formed by the inner rim and with the longitudinal axis of the foot supporting portion of the boot extending perpendicular to the plane formed by the single wheel; and an elastic member interconnecting the pair of mono-wheel assemblies, with each foot of the user being received within the boot of a respective one of said pair of mono-wheel assemblies.

4. A skate assembly according to claim 3, wherein the inner rim of each mono-wheel assembly has a convex profile and each of the guide wheels of each support frame has a circumferential outer surface with a concave profile which is in rolling engagement with the inner rim.

* * * * *